US011326362B2

(12) United States Patent
Wright

(10) Patent No.: US 11,326,362 B2
(45) Date of Patent: May 10, 2022

(54) FLOATATION ACCESSORY FOR A POOL VACUUM

(71) Applicant: Justin Paul Wright, Lake Worth, FL (US)

(72) Inventor: Justin Paul Wright, Lake Worth, FL (US)

( * ) Notice: Subject to any disclaimer, the term of this patent is extended or adjusted under 35 U.S.C. 154(b) by 0 days.

(21) Appl. No.: 17/127,744

(22) Filed: Dec. 18, 2020

(65) Prior Publication Data

US 2021/0189752 A1 Jun. 24, 2021

Related U.S. Application Data

(60) Provisional application No. 62/949,973, filed on Dec. 18, 2019.

(51) Int. Cl.
*E04H 4/12* (2006.01)

(52) U.S. Cl.
CPC ..... *E04H 4/1263* (2013.01)

(58) Field of Classification Search
CPC ..... E04H 4/1263
USPC ..... 210/167.19, 167.2, 242.1
See application file for complete search history.

(56) References Cited

U.S. PATENT DOCUMENTS 4,746,424 A * 5/1988 Drew ..... E04H 4/1263 134/167 R
4,802,592 A * 2/1989 Wessels ..... B01D 21/2433 137/404
5,350,508 A * 9/1994 Van der Watt ..... E04H 4/1263 15/1.7
5,498,348 A * 3/1996 Plink ..... E04H 4/1263 210/776
6,074,553 A * 6/2000 Haski ..... E04H 4/1263 210/167.2
2006/0060513 A1* 3/2006 Craig ..... E04H 4/1263 210/167.2
2012/0305461 A1* 12/2012 Veronie ..... E04H 4/1263 210/167.2
2016/0024810 A1* 1/2016 Bair ..... E04H 4/1263 210/242.1
2017/0022728 A1* 1/2017 Simik ..... C02F 1/008
2017/0051467 A1* 2/2017 Casadio ..... E02B 15/104
2021/0129948 A1* 5/2021 Wang ..... E02B 15/104

FOREIGN PATENT DOCUMENTS

EP 3467235 A2 * 4/2019

* cited by examiner

*Primary Examiner* — Fred Prince

(57) ABSTRACT

A floatation accessory for a pool vacuum is an apparatus that maintains an inverted position for a pool vacuum such that the mouth of the pool vacuum suctions debris along the surface of a pool. The apparatus includes a support platform, a first float, a second float, a support ridge, a handle, an elongated guard, and a suspension system. The support platform upholds the first float and the second float. The first float and the second float are used to float a pool vacuum that is engaged with the apparatus. The support ridge connects the first float and the second float and offsets the elongated guard from the mouth of a pool vacuum. The elongated guard offsets the mouth of a pool vacuum from the side walls of a pool. The suspension system loops a pool vacuum with the support platform, and consequently the first float and the second float.

18 Claims, 5 Drawing Sheets

FLOATATION ACCESSORY FOR A POOL VACUUM

The current application claims a priority to the U.S. provisional patent application Ser. No. 62/949,973 filed on Dec. 18, 2019.

FIELD OF THE INVENTION

The present invention generally relates to vacuum maintenance accessories. More specifically, the present invention is a floatation accessory for a pool vacuum.

BACKGROUND OF THE INVENTION

Having a community pool or a personal pool is quite desirable. However, pool maintenance can be extremely tedious and costly if not maintained correctly. Pool maintenance requires chemicals, cleaning tools, and measuring tools. A common chore of pool maintenance requires an individual to manual filter the debris that floats along the top of the pool. Depending on the location of the pool with respect to trees and landscape, plenty of lightweight debris may float across the surface of the pool daily.

It is an objective of the present invention to address this issue by providing a universal attachment for a motorized pool vacuum with flotation capabilities. The present invention inverts a pool vacuum to automatically remove debris from the surface of the pool. The present invention provides a lightweight and easily maneuverable accessory for motorized pool vacuums.

DETAIL DESCRIPTIONS OF THE INVENTION

All illustrations of the drawings are for the purpose of describing selected versions of the present invention and are not intended to limit the scope of the present invention.

Figure 1:
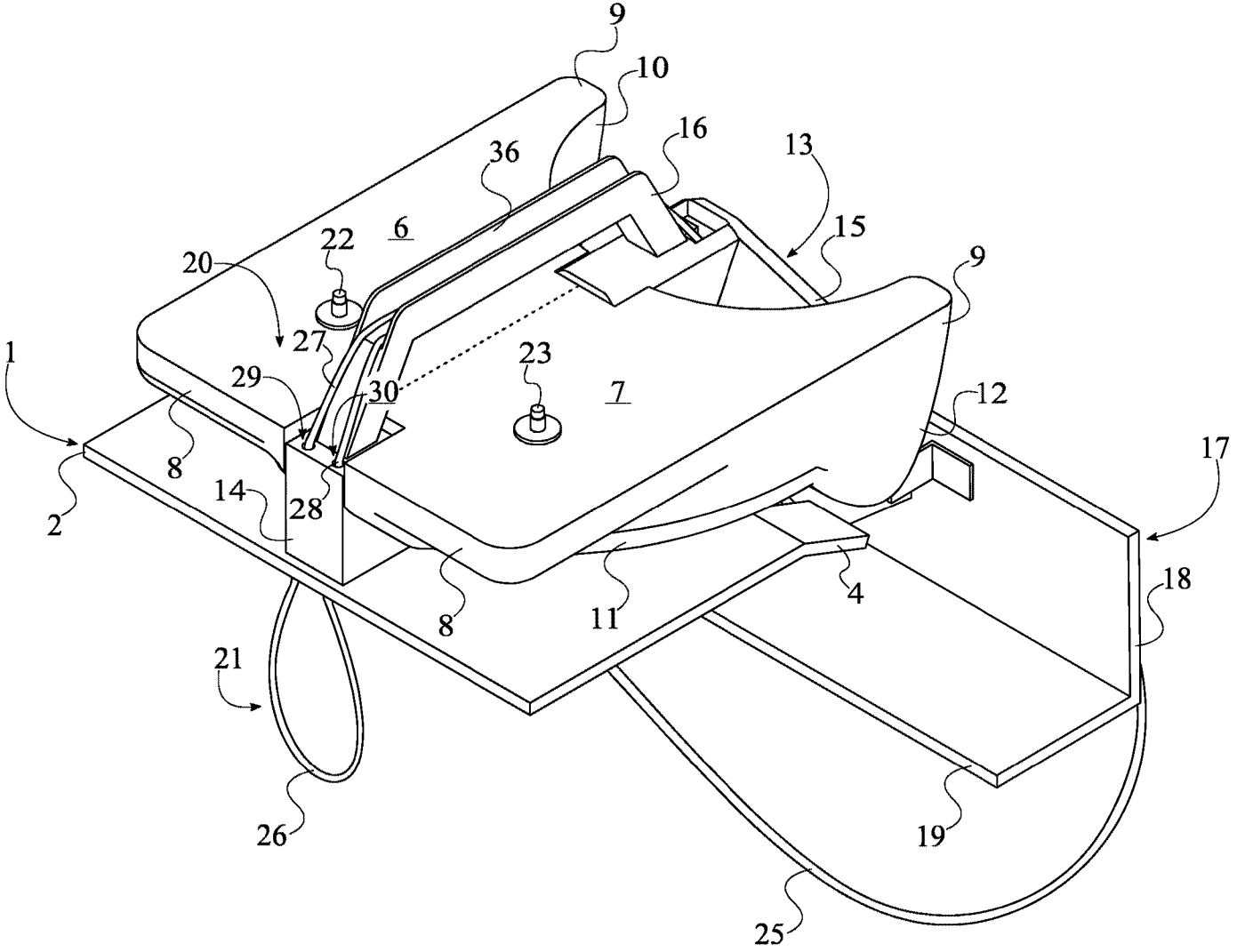
FIG. 1 is a top-front perspective view of the present invention.
Figure 2:
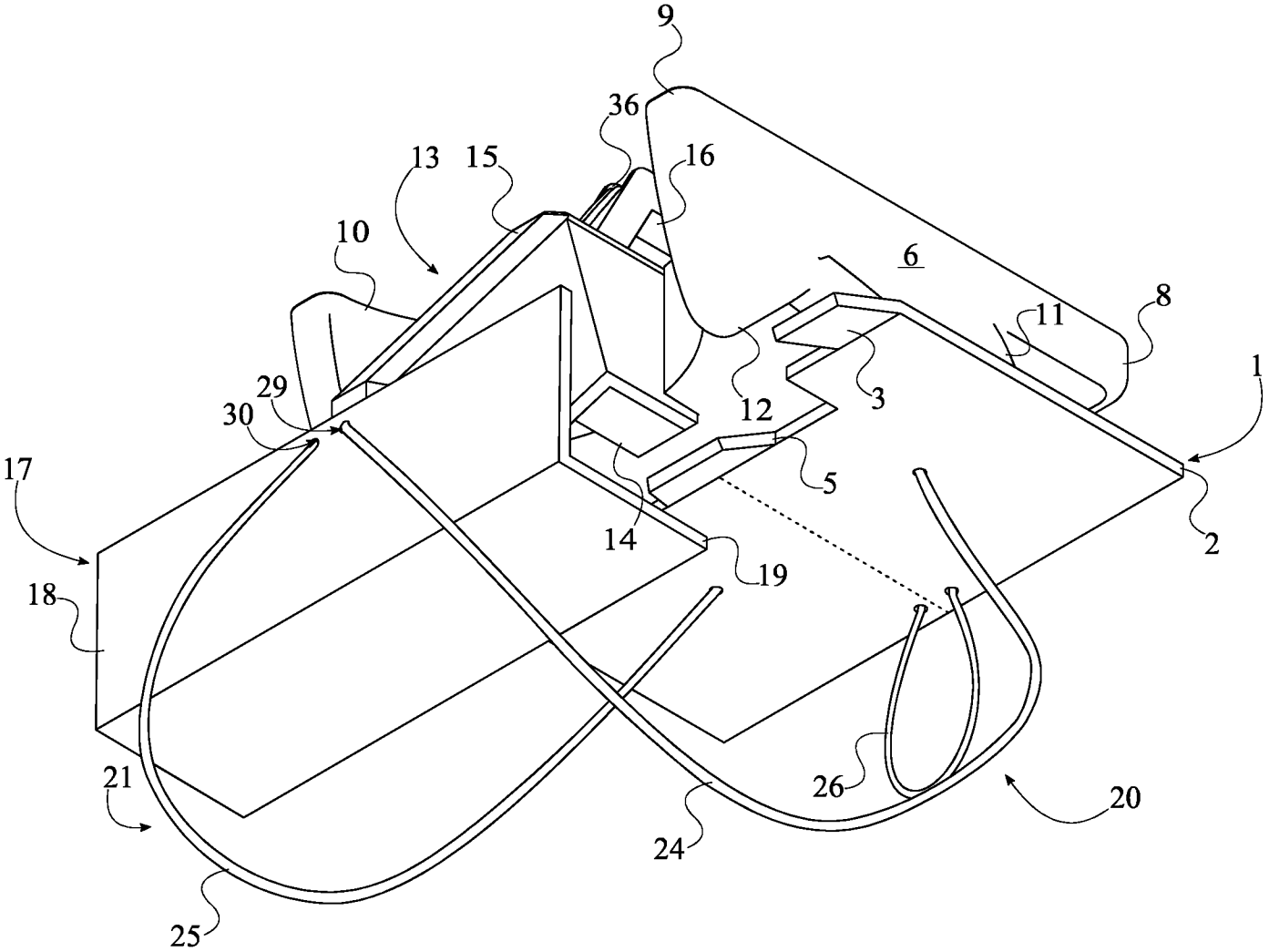
FIG. 2 is a bottom-rear perspective view of the present invention.
Figure 3:
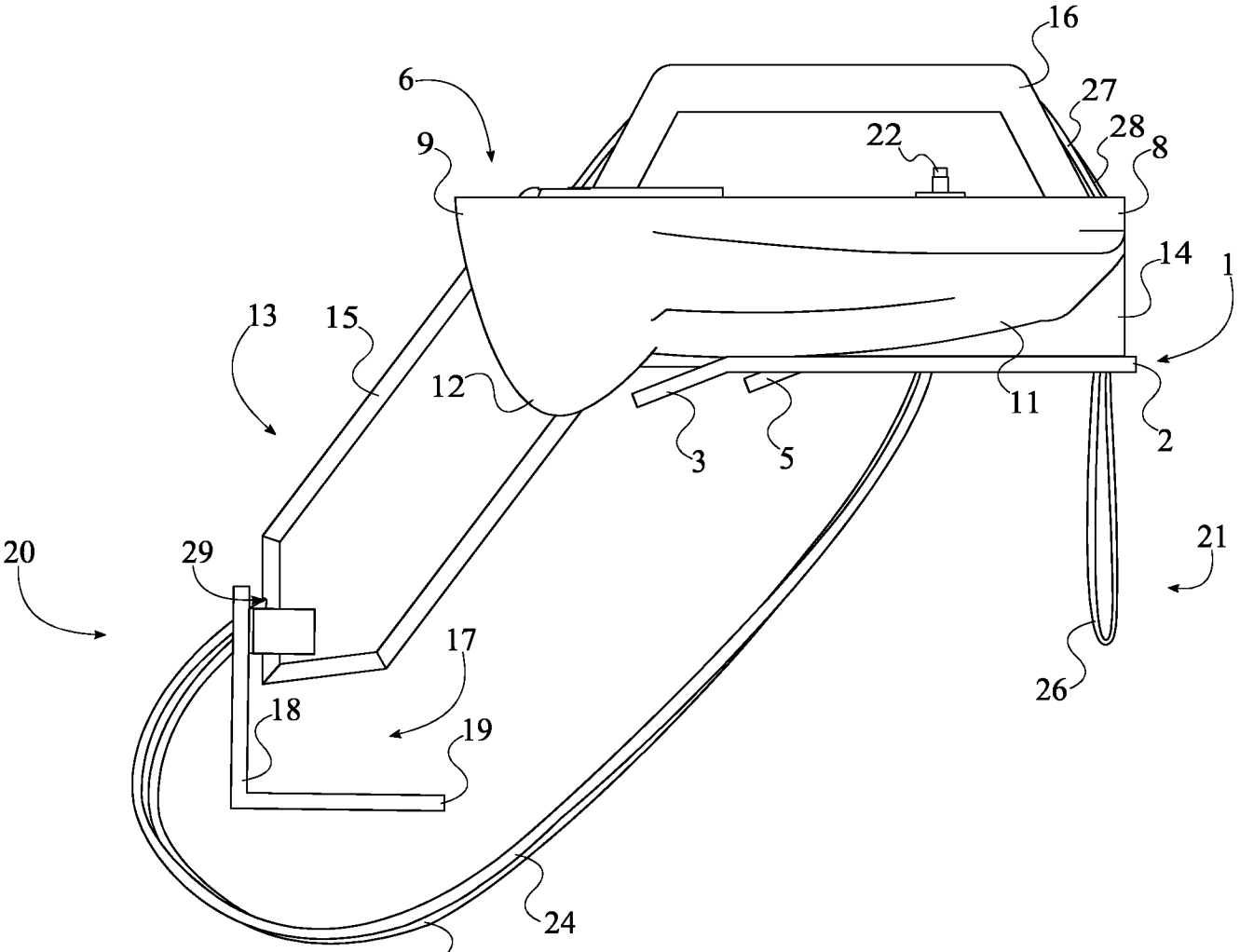
FIG. 3 is a left-side view of the present invention.

The present invention is a floatation accessory for a pool vacuum. The present invention inverts a pool vacuum so that the mouth of a pool vacuum may suction debris from the surface of a pool. The present invention serves as a universal accessory for pool vacuums and may be easily attached and detached from a pool vacuum. In order for any pool vacuum to remain upside down while skimming the surface of a pool, the present invention comprises a support platform 1, a first float 6, a second float 7, a support ridge 13, a handle 16, an elongated guard 17, and a suspension system 20, as seen in FIG. 1 and FIG. 2. The support platform 1 upholds the first float 6 and the second float 7. More specifically, the support platform 1 stabilizes the first float 6 and the second float 7 against a pool vacuum. The support ridge 13 connects the first float 6 with the second float 7 and offsets the elongated guard 17 from the mouth of a pool vacuum. The elongated guard 17 presses against the wall of a pool and is stabilized with the support shield so that the mouth of the pool vacuum continuously skim across the surface of the pool rather than suction against the wall of the pool. The suspension system 20 attaches a pool vacuum against the support platform 1 and orients the mouth of the pool vacuum towards the elongated guard 17.

The overall configuration of the aforementioned components orients a pool vacuum so that the inlet of a pool vacuum skims across the surface of the pool while in use. The present invention is stabilized and structurally sound as the support ridge 13 is fixed across and perpendicular to the support platform 1, as seen in FIG. 1, FIG. 2, FIG. 3, FIG. 4, and FIG. 5. The first float 6 and the second float 7 are mounted against the support ridge 13 and the support platform 1. This arrangement allows the present invention to float as well as the attached pool vacuum. More specifically, the support ridge 13 is positioned in between the first float 6 and the second float 7, thereby balancing the weight of the first float 6 and the weight of the second float 7. In order for a user to easily grasp onto the present invention while engaged with a pool vacuum, the handle 16 is fixed adjacent with the support ridge 13, opposite the support platform 1. The elongated guard 17 is terminally positioned and positioned perpendicular with the support ridge 13. This arrangement presses the elongated guard 17 against the walls of the pool and allows water to flow into the mouth of a pool vacuum. The elongated guard 17 is positioned offset with the support platform 1, allowing water to flow into the mouth of a pool vacuum, and consequently any debris along the surface of the pool as well. The present invention accommodates waves in the pool as the elongated guard 17 is hingedly connected with the support ridge 13 thereby allowing the elongated guard 17 to pivot accordingly. A pool vacuum remains attached against the support platform 1 as the suspension system 20 is integrated through the support platform 1, the first float 6, the second float 7, the support ridge 13, the handle 16, and the elongated guard 17.

The support platform 1 aids in the inverted orientation of a pool vacuum as the support platform 1 may comprise a main plate 2, a first side lip 3, a second side lip 4, and a central lip 5, as seen in FIG. 1, FIG. 2, FIG. 3, FIG. 4, and FIG. 5. The main plate 2 upholds the first float 6 and the second float 7. The first side lip 3, the second side lip 4, and the central lip 5 facilitates the smooth and continuous movement of the present invention across the pool. More specifically, the first side lip 3 and the second side lip 4 guide the flow of water along the sides of the first float 6 and the second float 7, respectively. The central lip 5 guides the flow of water between the first float 6 and the second float 7. In order for the first side lip 3, the second side lip 4, and the central lip 5 to guide the flow of water about the present invention and a pool vacuum, the first side lip 3, the second side lip 4, and the central lip 5 are peripherally positioned with the main plate 2. More specifically, the central lip 5 is positioned in between the first side lip 3 and the second side lip 4. The first side lip 3, the second side lip 4, and the central lip 5 are fixed with the main plate 2, to maintain the structural integrity of the support platform 1. The first side lip 3, the second side lip 4, and the central lip 5 are positioned at an obtuse angle with the main plate 2, also guiding the flow of water and consequently any debris towards the opening of a pool vacuum. Furthermore, the first side lip 3, the second side lip 4, and the central lip 5 are oriented towards the elongated guard 17 as the mouth of the pool vacuum is oriented towards the elongated guard 17 as well.

In order to effectively shield the mouth of a pool vacuum from the walls of a pool, the elongated guard 17 may comprise a first panel 18 and a second panel 19, as seen in FIG. 1, FIG. 2, FIG. 3, FIG. 4, and FIG. 5. The first panel 18 and the second panel 19 press against the walls of the pool so that the mouth does not readily suction along the walls. The elongated shield traverses across the mouth of the pool vacuum as the first panel 18 is positioned adjacent and along with the second panel 19. The second panel 19 is positioned perpendicular with the first plate and fixed with the first panel 18, thereby surrounding the entirety of the mouth while being able to press evenly across the wall of a pool. The support ridge 13 is hingedly connected with the first panel 18, allowing either the first panel 18 or the second panel 19 to press against the wall of the pool depending on the waves of the pool. The second panel 19 is oriented towards the support platform 1 and is positioned opposite the handle 16 about the support ridge 13 to maintain the balance of the present invention with the pool vacuum along the surface of the pool while directing any debris towards the mouth of the pool vacuum.

In order to secure the support platform 1 with the elongated guard 17, the support ridge 13 may comprise a first ridge portion 14 and a second ridge portion 15, seen in FIG. 1 and FIG. 2. The first ridge portion 14 connects with the support platform 1, and the second ridge portion 15 connects with the elongated guard 17. The present invention remains balanced from side to side as the first ridge portion 14 is positioned in between the first float 6 and the second float 7, and the second ridge portion 15 is serially positioned with the first ridge portion 14. The second ridge portion 15 is oriented at an obtuse angle with the first ridge portion 14 in order to balance the weight of the support platform 1, the first float 6, and the second float 7 with that of the elongated guard 17. The handle 16 is fixed along the first ridge portion 14 as the first ridge portion 14 remains parallel with the surface. The elongated guard 17 is positioned offset with the support platform 1, and consequently the mouth of a pool vacuum, as the elongated guard 17 is hingedly connected with the second ridge portion 15.

In order for the first float 6 and the second float 7 to smoothly steer across the surface of the pool, the first float 6 and the second float 7 may each comprise a main body 8, a tail portion 9, a keel portion 11, and a rudder portion 12, as seen in FIG. 1, FIG. 2, FIG. 3, FIG. 4, and FIG. 5. The tail portion 9 is positioned adjacent with the main body 8 and oriented towards the elongated guard 17. The keel portion 11 is positioned adjacent with the main body 8 and positioned in between the main body 8 and the support platform 1. The rudder portion 12 is positioned adjacent with the tail portion 9 and is oriented away from the handle 16. Furthermore, the tail portion 9 may comprise a concave surface 10 to preserve a tapered structure for the first float 6 and the second float 7, respectively. The concave surface 10 is positioned adjacent with the support ridge 13.

In order attach a pool vacuum with the present invention without adding weight to the present invention, the suspension system 20 may comprise a cable 21, a set of left-side channels 29, a set of right-side channels 30, and a groove 36, as seen in FIG. 1, FIG. 2, FIG. 3, FIG. 4, and FIG. 5. The cable 21 surrounds the pool vacuum, and the set of left-side channels 29, the set of right-side channels 30, and the groove 36 allows the cable 21 to securely intertwine through the first float 6, the second float 7, the support platform 1, the support ridge 13, and the handle 16. More specifically, the set of left-side channels 29 and the set of right-side channels 30 allows the cable 21 to loop and tighten around a pool vacuum. In order for the cable 21 to provide at least one loop to secure the pool vacuum, the cable 21 may comprise a first fixed end 22 and a second fixed end 23. The first fixed end 22 is positioned opposite the second fixed end 23 along the cable 21. The set of left-side channels 29 and the set of right-side channels 30 are positioned opposite each other about the support ridge 13, allowing the cable 21 to evenly wrap around a pool vacuum. The set of left-side channels 29 traverses through the first float 6, the support platform 1, the elongated guard 17, and the support ridge 13. Likewise, the set of right-side channels 30 traverses through the second float 7, the support platform 1, the elongated guard 17, and the support ridge 13. In order to tighten the cable 21 between the left-side channels 29 and the right-side channels 30, the groove 36 laterally traverses into and along the handle 16. The groove 36 is oriented away from the support platform 1, allowing the user to access the cable 21 positioned along the groove 36. In order for the cable 21 to pull the pool vacuum towards the support platform 1 and tighten the pool vacuum with against the support platform 1, the first fixed end 22 is positioned adjacent with the first float 6, opposite the support platform 1, and is externally tethered with the first float 6. Likewise, the second end is positioned adjacent with the second float 7, opposite the support platform 1, and is externally tethered with the second float 7. The cable 21 serves as a fastener with a pool vacuum as the cable 21 is woven through the set of left-side channels 29, the groove 36, and the set of right-side channels 30.

Figure 4:
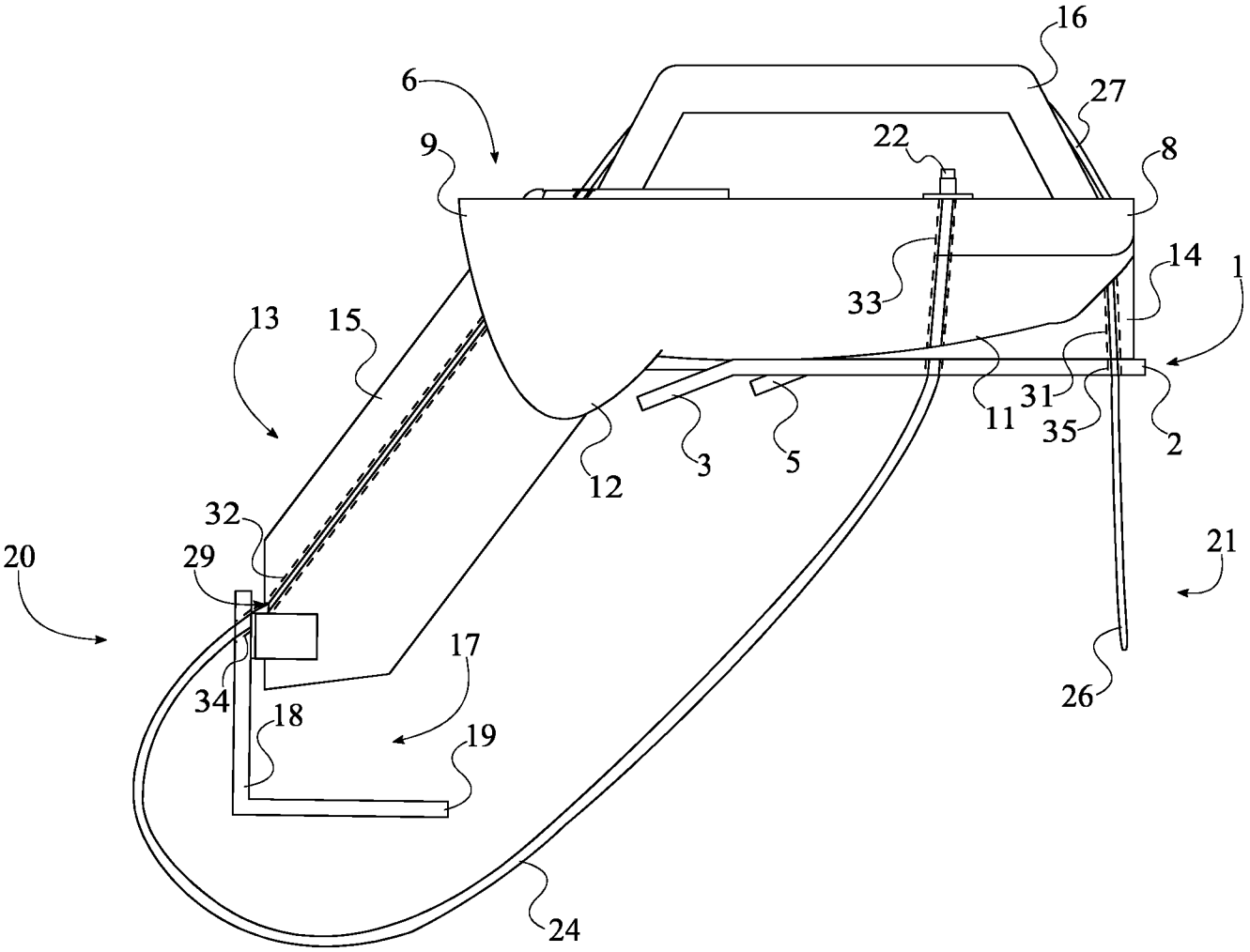
FIG. 4 is a schematic left-side view of a cable and a set of left-side channels of the present invention.
Figure 5:
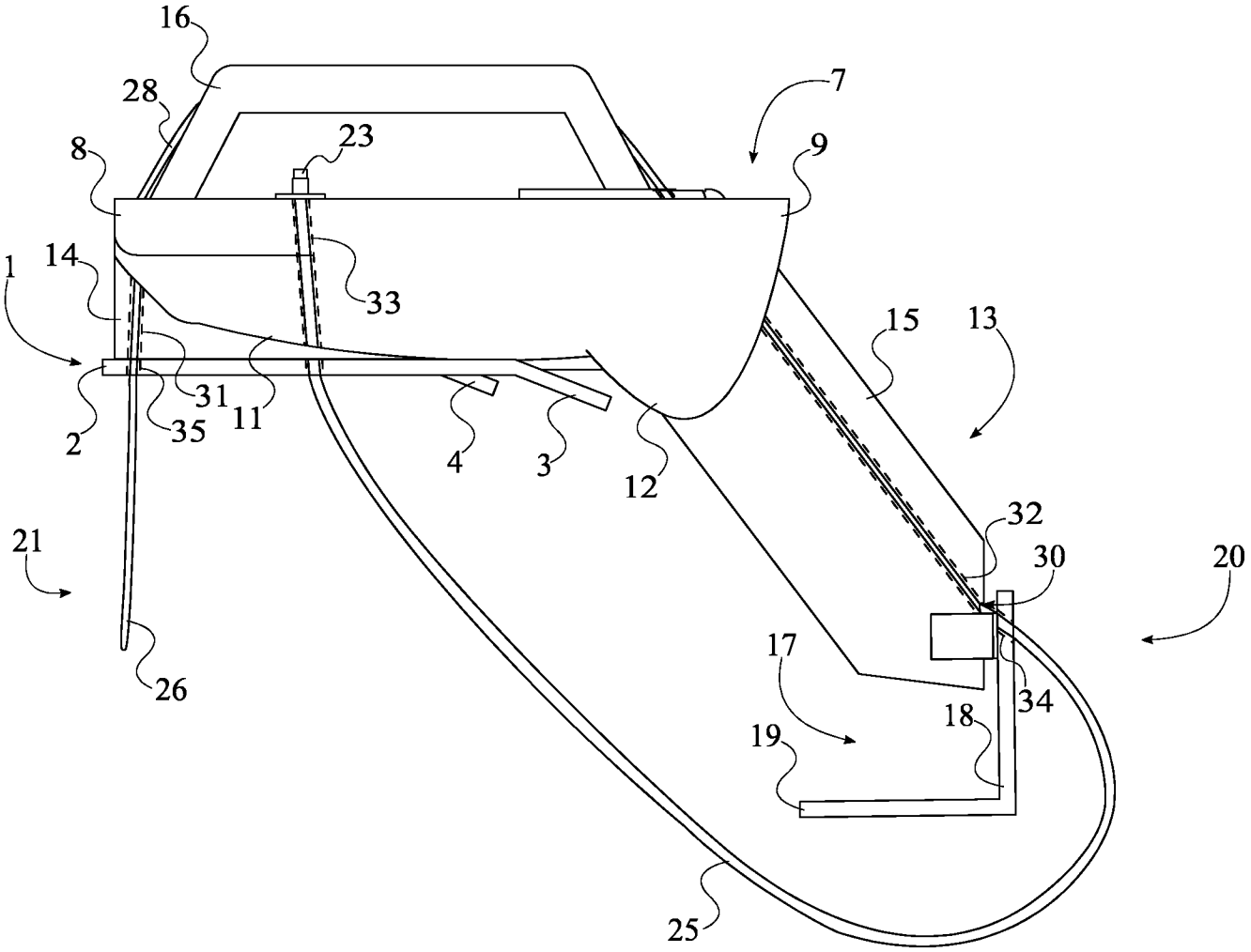
FIG. 5 is a schematic right-side view of the cable and a set of right-side channels of the present invention.

Portions of the cable 21 are positioned as loops around parts of a pool vacuum as the set of left-side channels 29 and the set of right-side channels 30 may each comprise a first ridge channel 31, a second ridge channel 32, a side channel 33, a shield channel 34, and a central channel 35, seen in FIG. 4 and FIG. 5. The first ridge channel 31 and the second ridge channel 32 provide paths for the cable 21 through the support ridge 13. The side channel 33 provides a path for the cable 21 through the first float 6 and the second float 7, respectively, as well as the support platform 1. Likewise, the central channel 35 provides a path for the cable 21 through the support platform 1. The shield channel 34 provides a path for the cable 21 through the elongated guard 17. The first ridge channel 31 and the second ridge channel 32 traverses through and along the support ridge 13. More specifically, the handle 16 is positioned in between the first ridge channel 31 and the second ridge channel 32. The side channel 33 of the set of left-side channels 29 traverses through the first float 6 and the support platform 1. Likewise, the side channel 33 of the set of right-side channels 30 traverses through the second float 7 and the support platform 1. In order for the cable 21 to loop around the sides of a pool vacuum, the shield channel 34 traverses through the elongated guard 17 and is positioned adjacent with the second ridge channel 32. In order for the cable 21 to loop around the handlebar of a pool vacuum, the central channel 35 traverses through the support platform 1 and is positioned adjacent with the first ridge channel 31. In order for the cable 21 to be able to fasten about itself around the first float 6, the second float 7, the support platform 1, the elongated guard 17, and the support ridge 13, the cable 21 traverses out of the side channel 33, through the shield channel 34, through the second ridge channel 32, through the first ridge channel 31, and to the central channel 35.

More specifically, as seen in FIG. 1, FIG. 2, FIG. 3, FIG. 4, and FIG. 5, the left side for a head of a pool vacuum is strapped onto the support platform 1 as a left suspension loop 24 of the cable 21 traverses from the side channel 33 for the set of left-side channels 29 to the shield channel 34 for the set of left-side channels 29. Likewise, the right side for a head of a pool vacuum is strapped onto the support platform 1 as a right suspension loop 25 of the cable 21 traverses from the side channel 33 for the set of right-side channels 30 to the shield channel 34 for the set of right-side channels 30. The handlebar of a pool vacuum is strapped onto the support platform 1 in order to effectively orient the mouth for a head of the vacuum as a central suspension loop 26 of the cable 21 traverses from the central channel 35 for the set of left-side channels 29 to the central channel 35 for the set of right-side channels 30.

The cable 21 is secured with the handle 16 as a left tension loop 27 of the cable 21 traverses from the second ridge channel 32 for the set of left-side channels 29, through the groove 36, and to the first ridge channel 31 for the set of left-side channels 29, as seen in FIG. 1, FIG. 2, and FIG. 4. Likewise, a right tension loop 28 of the cable 21 traverses from the second ridge channel 32 for the set of right-side channels 30, through the groove 36, and to the first ridge channel 31 for the set of right-side channels 30, as seen in FIG. 1, FIG. 2, and FIG. 4. Therefore, in order for a user to secure a pool vacuum against the support platform 1 with the cable 21, the head of a pool vacuum is properly positioned into the left suspension loop 24, the right suspension loop 25, and the central suspension loop 26. The left tension loop 27 and the right tension loop 28 is pulled into the groove 36 along the handle 16. Conversely, the left tension loop 27 and the right tension loop 28 is removed from the groove 36 and the left suspension loop 24, the right suspension loop 25, and the central suspension loop 26 is loosened. Once the pool vacuum is separated from the present invention, the handle 16 may be engaged to remove the present invention from the pool.

Although the invention has been explained in relation to its preferred embodiment, it is to be understood that many other possible modifications and variations can be made without departing from the spirit and scope of the invention as hereinafter claimed.

What is claimed is:

1. A floatation accessory for a pool vacuum comprises:
- a support platform;
- a first float;
- a second float;
- a support ridge;
- a handle;
- an elongated guard;
- a suspension system;
- the support ridge being fixed across and perpendicular to the support platform;
- the first float and the second float being mounted against the support ridge and the support platform;
- the support ridge being positioned in between the first float and the second float;
- the handle being fixed adjacent with the support ridge, opposite the support platform;
- the elongated guard being terminally positioned with the support ridge;
- the elongated guard being positioned perpendicular with the support ridge;
- the elongated guard being positioned offset from the support platform;
- the elongated guard being hingedly connected with the support ridge; and,
- the suspension system being integrated through the support platform, the first float, the second float, the support ridge, the handle, and the elongated guard.

2. The floatation accessory for a pool vacuum as claimed in claim 1 comprises:
- the support platform comprises a main plate, a first side lip, a second side lip, and a central lip;
- the first side lip, the second side lip, and the central lip being peripherally positioned with the main plate;
- the central lip being positioned in between the first side lip and the second side lip;
- the first side lip, the second side lip, and the central lip being fixed with the main plate;
- the first side lip, the second side lip, and the central lip being positioned at an obtuse angle with the main plate; and,
- the first side lip, the second side lip, and the central lip being oriented towards the elongated guard.

3. The floatation accessory for a pool vacuum as claimed in claim 1 comprises:
- the elongated guard comprises a first panel and a second panel;
- the first panel being positioned adjacent and along with the second panel;
- the second panel being positioned perpendicular with the first plate;
- the second panel being fixed with the first panel;
- the support ridge being hingedly connected with the first panel;
- the second panel being oriented towards the support platform; and,
- the second panel being positioned opposite the handle about the support ridge.

4. The floatation accessory for a pool vacuum as claimed in claim 1 comprises:
- the support ridge comprises a first ridge portion and a second ridge portion;
- the first ridge portion being positioned in between the first float and the second float;
- the second ridge portion being serially positioned with the first ridge portion;
- the second ridge portion being oriented at an obtuse angle with the first ridge portion;
- the handle being fixed along the first ridge portion; and,
- the elongated guard being hingedly connected with the second ridge portion.

5. The floatation accessory for a pool vacuum as claimed in claim 1 comprises:
- the first float and the second float each comprise a main body, a tail portion, a keel portion, and a rudder portion;
- the tail portion being positioned adjacent with the main body;
- the tail portion being oriented towards the elongated guard;
- the keel portion being positioned adjacent with the main body;
- the keel portion being positioned in between the main body and the support platform;
- the rudder portion being positioned adjacent with the tail portion; and,
- the rudder portion being oriented away from the handle.

6. The floatation accessory for a pool vacuum as claimed in claim 5 comprises:
- the tail portion comprises a concave surface; and,
- the concave surface being positioned adjacent with the support ridge.

7. The floatation accessory for a pool vacuum as claimed in claim 1 comprises:
- the suspension system comprises a cable, a set of left-side channels, a set of right-side channels, and a groove;
- the cable comprises a first fixed end and a second fixed end;

the first fixed end being positioned opposite the second fixed end along the cable;

the set of left-side channels and the set of right-side channels being positioned opposite each other about the support ridge;

the set of left-side channels traversing through the first float, the support platform, the elongated guard, and the support ridge;

the set of right-side channels traversing through the second float, the support platform, the elongated guard, and the support ridge;

the groove laterally traversing into and along the handle;

the groove being oriented away from the support platform;

the first fixed end being positioned adjacent with the first float, opposite the support platform;

the first fixed end being externally tethered with the first float;

the second fixed end being positioned adjacent with the second float, opposite the support platform;

the second fixed end being externally tethered with the second float; and, the cable being woven through the set of left-side channels, the groove, and the set of right-side channels.

8. The floatation accessory for a pool vacuum as claimed in claim 7 comprises:

the set of left-side channels and the set of right-side channels each comprise a first ridge channel, a second ridge channel, a side channel, a shield channel, and a central channel;

the first ridge channel and the second ridge channel traversing through and along the support ridge;

the handle being positioned in between the first ridge channel and the second ridge channel;

the side channel of the set of left-side channels traversing through the first float and the support platform;

the side channel of the set of right-side channels traversing through the second float and the support platform;

the shield channel traversing through the elongated guard;

the shield channel being positioned adjacent with the second ridge channel;

the central channel traversing through the support platform;

the central channel being positioned adjacent with the first ridge channel; and, the cable traversing out of the side channel, through the shield channel, through the second ridge channel, through the first ridge channel, and to the central channel.

9. The floatation accessory for a pool vacuum as claimed in claim 8 comprises:

a left suspension loop of the cable traversing from the side channel for the set of left-side channels to the shield channel for the set of left-side channels;

a right suspension loop of the cable traversing from the side channel for the set of right-side channels to the shield channel for the set of right-side channels; and, a central suspension loop of the cable traversing from the central channel for the set of left-side channels to the central channel for the set of right-side channels.

10. The floatation accessory for a pool vacuum as claimed in claim 8 comprises:

a left tension loop of the cable traversing from the second ridge channel for the set of left-side channels, through the groove, and to first ridge channel for the set of left-side channels; and, a right tension loop of the cable traversing from the second ridge channel for the set of right-side channels, through the groove, and to first ridge channel for the set of right-side channels.

11. A floatation accessory for a pool vacuum comprises:

a support platform;

a first float;

a second float;

a support ridge;

a handle;

an elongated guard;

a suspension system;

the suspension system comprises a cable, a set of left-side channels, a set of right-side channels, and a groove;

the cable comprises a first fixed end and a second fixed end;

the support ridge being fixed across and perpendicular to the support platform;

the first float and the second float being mounted against the support ridge and the support platform;

the support ridge being positioned in between the first float and the second float;

the handle being fixed adjacent with the support ridge, opposite the support platform;

the elongated guard being terminally positioned with the support ridge;

the elongated guard being positioned perpendicular with the support ridge;

the elongated guard being positioned offset from the support platform;

the elongated guard being hingedly connected with the support ridge;

the suspension system being integrated through the support platform, the first float, the second float, the support ridge, the handle, and the elongated guard;

the first fixed end being positioned opposite the second fixed end along the cable;

the set of left-side channels and the set of right-side channels being positioned opposite each other about the support ridge;

the set of left-side channels traversing through the first float, the support platform, the elongated guard, and the support ridge;

the set of right-side channels traversing through the second float, the support platform, the elongated guard, and the support ridge;

the groove laterally traversing into and along the handle;

the groove being oriented away from the support platform;

the first fixed end being positioned adjacent with the first float, opposite the support platform;

the first fixed end being externally tethered with the first float;

the second fixed end being positioned adjacent with the second float, opposite the support platform;

the second fixed end being externally tethered with the second float; and, the cable being woven through the set of left-side channels, the groove, and the set of right-side channels.

12. The floatation accessory for a pool vacuum as claimed in claim 11 comprises:

the support platform comprises a main plate, a first side lip, a second side lip, and a central lip;

the first side lip, the second side lip, and the central lip being peripherally positioned with the main plate;

the central lip being positioned in between the first side lip and the second side lip;

the first side lip, the second side lip, and the central lip being fixed with the main plate;

the first side lip, the second side lip, and the central lip being positioned at an obtuse angle with the main plate; and, the first side lip, the second side lip, and the central lip being oriented towards the elongated guard.

13. The floatation accessory for a pool vacuum as claimed in claim 11 comprises:

the elongated guard comprises a first panel and a second panel;

the first panel being positioned adjacent and along with the second panel;

the second panel being positioned perpendicular with the first plate;

the second panel being fixed with the first panel;

the support ridge being hingedly connected with the first panel;

the second panel being oriented towards the support platform; and, the second panel being positioned opposite the handle about the support ridge.

14. The floatation accessory for a pool vacuum as claimed in claim 12 comprises:

the support ridge comprises a first ridge portion and a second ridge portion;

the first ridge portion being positioned in between the first float and the second float;

the second ridge portion being serially positioned with the first ridge portion;

the second ridge portion being oriented at an obtuse angle with the first ridge portion;

the handle being fixed along the first ridge portion; and, the elongated guard being hingedly connected with the second ridge portion.

15. The floatation accessory for a pool vacuum as claimed in claim 11 comprises:

the first float and the second float each comprise a main body, a tail portion, a keel portion, and a rudder portion;

the tail portion comprises a concave surface;

the tail portion being positioned adjacent with the main body;

the tail portion being oriented towards the elongated guard;

the keel portion being positioned adjacent with the main body;

the keel portion being positioned in between the main body and the support platform;

the rudder portion being positioned adjacent with the tail portion;

the rudder portion being oriented away from the handle; and, the concave surface being positioned adjacent with the support ridge.

16. The floatation accessory for a pool vacuum as claimed in claim 11 comprises:

the set of left-side channels and the set of right-side channels each comprise a first ridge channel, a second ridge channel, a side channel, a shield channel, and a central channel;

the first ridge channel and the second ridge channel traversing through and along the support ridge;

the handle being positioned in between the first ridge channel and the second ridge channel;

the side channel of the set of left-side channels traversing through the first float and the support platform;

the side channel of the set of right-side channels traversing through the second float and the support platform;

the shield channel traversing through the elongated guard;

the shield channel being positioned adjacent with the second ridge channel;

the central channel traversing through the support platform;

the central channel being positioned adjacent with the first ridge channel; and, the cable traversing out of the side channel, through the shield channel, through the second ridge channel, through the first ridge channel, and to the central channel.

17. The floatation accessory for a pool vacuum as claimed in claim 16 comprises:

a left suspension loop of the cable traversing from the side channel for the set of left-side channels to the shield channel for the set of left-side channels;

a right suspension loop of the cable traversing from the side channel for the set of right-side channels to the shield channel for the set of right-side channels; and, a central suspension loop of the cable traversing from the central channel for the set of left-side channels to the central channel for the set of right-side channels.

18. The floatation accessory for a pool vacuum as claimed in claim 16 comprises:

a left tension loop of the cable traversing from the second ridge channel for the set of left-side channels, through the groove, and to first ridge channel for the set of left-side channels; and, a right tension loop of the cable traversing from the second ridge channel for the set of right-side channels, through the groove, and to first ridge channel for the set of right-side channels.

* * * * *